US008695981B2

(12) United States Patent
Jones

(10) Patent No.: US 8,695,981 B2
(45) Date of Patent: Apr. 15, 2014

(54) CASINO CARD GAME

(75) Inventor: Mark H. Jones, Magalia, CA (US)

(73) Assignee: Inag, Inc., Magalia, CA (US)

( * ) Notice: Subject to any disclaimer, the term of this patent is extended or adjusted under 35 U.S.C. 154(b) by 147 days.

(21) Appl. No.: 12/912,276

(22) Filed: Oct. 26, 2010

(65) Prior Publication Data

US 2011/0095482 A1 Apr. 28, 2011

Related U.S. Application Data

(60) Provisional application No. 61/255,128, filed on Oct. 27, 2009.

(51) Int. Cl.
*A63F 1/00* (2006.01)

(52) U.S. Cl.
USPC ..... 273/292; 273/294

(58) Field of Classification Search
USPC ..... 273/292, 274; 463/14
See application file for complete search history.

(56) References Cited

U.S. PATENT DOCUMENTS

| | | | | |
|---|---|---|---|---|
| 830,424 | A | 9/1906 | Ferris | |
| 3,841,637 | A | 10/1974 | Piazza et al. | |
| 3,998,462 | A * | 12/1976 | Goott | 273/274 |
| 5,184,821 | A * | 2/1993 | Korenek | 273/138.2 |
| 5,695,192 | A | 12/1997 | Brown | |
| 5,918,884 | A | 7/1999 | DiMuro | |
| 5,961,119 | A | 10/1999 | Brown | |
| 6,227,969 | B1 | 5/2001 | Yoseloff | |
| 6,692,003 | B2 | 2/2004 | Potter et al. | |
| 6,776,413 | B2 | 8/2004 | Brown, III | |
| 7,207,562 | B1 | 4/2007 | Gallagher et al. | |
| 7,413,193 | B2 | 8/2008 | Cacas | |
| 7,654,530 | B2 | 2/2010 | Smith et al. | |
| 7,669,853 | B2 | 3/2010 | Jones | |
| 2005/0167912 | A1 * | 8/2005 | Sokolov | 273/142 R |
| 2009/0250873 | A1 | 10/2009 | Jones | |

* cited by examiner

*Primary Examiner* — Michael Dennis
(74) *Attorney, Agent, or Firm* — Dickinson Wright PLLC

(57) ABSTRACT

A casino card game (20) including a plurality of cards (23) having values, suits, and colors are disposed in a vertical shuffler (22). The game (20) also includes a betting surface (21) presenting a plurality of wagering areas (26-38) corresponding to the values, suits, and colors of the cards in the vertical shuffler (22). The betting surface (21) further includes a plurality of player positions, each identified with a unique indicia (24). During each round of the game, players place wagers on the wagering areas (26-38) of the betting surface (21) and a dealer spins the vertical shuffler (22) to determine a winning card (23). The dealer then identifies each of the wagering areas (26-38) associated with the value, suit, and color of the winning card, if any, and pays the wagers on those identified wagering areas (26-38) according to a predetermined payout.

18 Claims, 4 Drawing Sheets

CASINO CARD GAME

CROSS REFERENCE TO RELATED APPLICATION

This application claims the benefit of U.S. Provisional Application No. 61/255,128 filed on Oct. 27, 2009, the entire disclosure of which is hereby incorporated by reference.

BACKGROUND OF THE INVENTION

1. Field of the Invention

The present invention relates to a method for playing a game of chance, and more particularly, toward a method for playing a casino card game.

2. Description of the Prior Art

The games of Money Wheel and Big Six are well established casino games including a random point generating device in the form of a large vertical playing wheel, and a betting surface. The playing wheel presents a plurality of fixed symbols along its circumference, and the betting surface presents a plurality of wagering areas corresponding to the fixed symbols on the playing wheel. The betting surface further presents a plurality of player positions, and at least one player is positioned at one of the player positions. Each round of the game starts with the players placing wagers on the wagering areas. Once all of the wagers are placed, the dealer spins the playing wheel, and a winning symbol is determined once the playing wheel comes to a stop at the twelve o'clock (12:00) position. Next, the wagering area associated with the winning symbol is identified. The wagers placed on the identified wagering area are paid according to a predetermined pay-out. In the Money Wheel and Big Six games, only one wagering area is identified during each round, i.e. the wagering area associated with the winning symbol.

U.S. Pat. No. 6,692,003, issued to Potter et al. on Feb. 17, 2004 (hereinafter referred to as "Potter"), discloses a Big Six game as described above, but also including an side bet symbol generator and a side bet wagering area. In addition to placing wagers on the wagering areas associated with the symbols on the playing wheel, players can place wagers on the side bet wagering area. During each round, the dealer simultaneously spins the playing wheel and activates the side bet symbol generator. If the correct symbol is generated by the side bet generator, then the side bet wagering area is identified along with the wagering area associated with the winning symbol. In other words, Potter shows a Big Six game in which more than one wagering area may be identified during each round, but Potter requires a side bet symbol generator to do so.

U.S. Pat. No. 5,918,884, issued to DiMuro on Jul. 6, 1999, shows a casino card game including a betting surface and a card selector for determining a winning card. The betting surface presents a plurality of value wagering areas for wagering on the value of the winning card and a plurality of suit wagering areas for wagering on the suit of the winning card. During each round, the card selector chooses the winning card, and the value and suit wagering areas corresponding to the winning card are identified.

SUMMARY OF THE INVENTION AND ADVANTAGES

The present invention provides for such a casino card game and wherein the card selector is a vertical shuffler rotationally disposed adjacent to the playing surface and including a flapper. Each round of the game includes the step of determining the winning card by spinning the vertical shuffler and allowing the vertical shuffler to come to a rest with the flapper pointing at the winning card.

The present invention provides for a unique casino game because it combines the excitement of the vertical shuffler with a game allowing for more than one winning wagering area during a single turn. This is accomplished with a single spin of the vertical shuffler, and there is no need for the side bet symbol generator of the Potter reference. Because there is no side betting, no separate wagering areas are required. All wagering areas are contained within the game itself. Moreover, the present invention requires very few rules and is simple for a new player to understand, which makes it attractive to many players.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
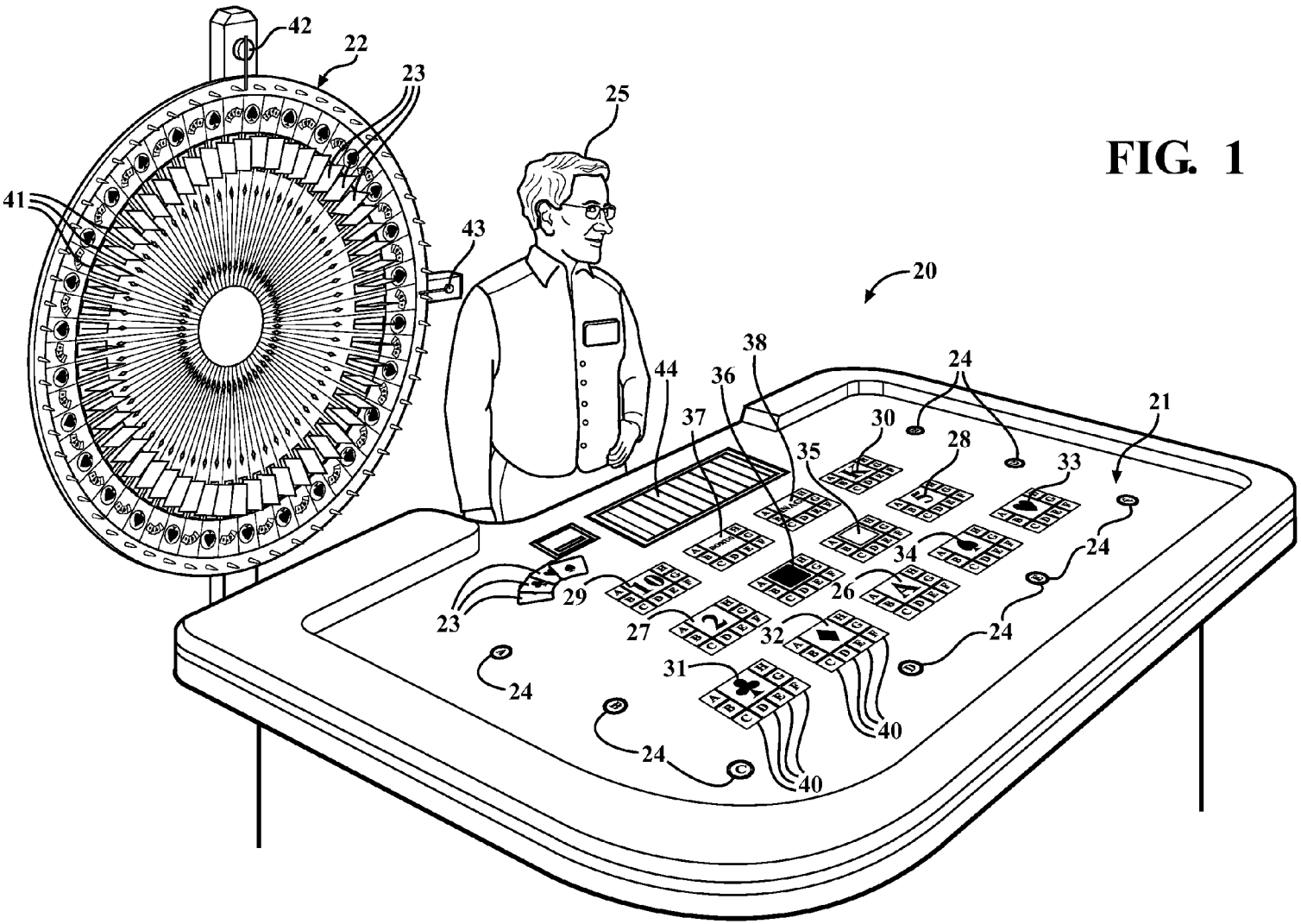
FIG. 1 is a perspective view of the exemplary embodiment of the casino card game.

Referring to the Figures, wherein like numerals indicate corresponding parts throughout the several views, an exemplary embodiment of a casino card game 20 is generally shown in FIG. 1. The casino card game 20 can be played on a physical table, as shown in FIG. 1, or played electronically on a computer or electronic gaming terminal. The casino card game 20 includes a betting surface 21, generally shown in FIG. 2. In the electronic version, the betting surface 21 is displayed on a monitor or a projector (not shown). The casino card game 20 also includes a card selector 22, generally shown in FIG. 3, for determining a winning card 23 during each round of play. The card selector 22 could take many physical forms. In the illustrated embodiment, the card selector 22 comprises a spinning wheel supported for rotation in a generally vertical plane, referred to hereafter as a vertical shuffler 22. In the electronic version of the game, the card selector 22 could be a simulated representation of the spinning card wheel coupled with a random numerical generator on a computer.

A plurality of physical cards 23 are disposed in the card selector 22. The cards 23 could be geometrically similar to normal playing cards 23 used for card 23 games like poker, blackjack, and the like, or the cards 23 could have any other desired geometry. In the exemplary embodiment, a plurality of normal playing cards 23, each having a value, a suit, and a color are disposed in the card selector 22 along with two special cards 23, i.e. an INAG special card and a BONANZA special card. The special cards 23 do not have a suit or a color. (The term INAG is a trademark of Innovations in Native American Gaming of Magalia, Calif.)

The normal playing cards 23 are proportionally disposed in the card selector 22 to determine the odds of each of the cards 23 being the winning card 23. In the exemplary embodiment, twenty-four of the playing cards 23 have an ace value, fifteen of the playing cards 23 have a deuce value, seven of the playing cards 23 have a five value, four of the playing cards 23 have a ten value, and two of the playing cards 23 have a king value. Thirteen of the playing cards 23 have each of the four suits, i.e. clubs, spades, diamonds, and hearts. Further, twenty-six of the playing cards 23 have each of the two colors, i.e. black and red. In summary, there are fifty-four total cards 23 with fifty-two of them being normal playing cards 23 and two of them being special cards 23. Of those normal playing cards 23, they are evenly distributed among the four suits and the two colors.

Because there are more cards 23 with an ace value in the card selector 22 than any other value, the chances of the winning card 23 having an ace value are greater than the chances of the winning card 23 having any other single value. Likewise, there is only one of each of the special cards 23 in the card selector 22, so the chances of the winning card 23 having either an INAG value or a BONANZA value are very slim. The pay-outs in the game should reflect the relative chance of the winning card 23 having the respective value, suit, or color.

Figure 2:
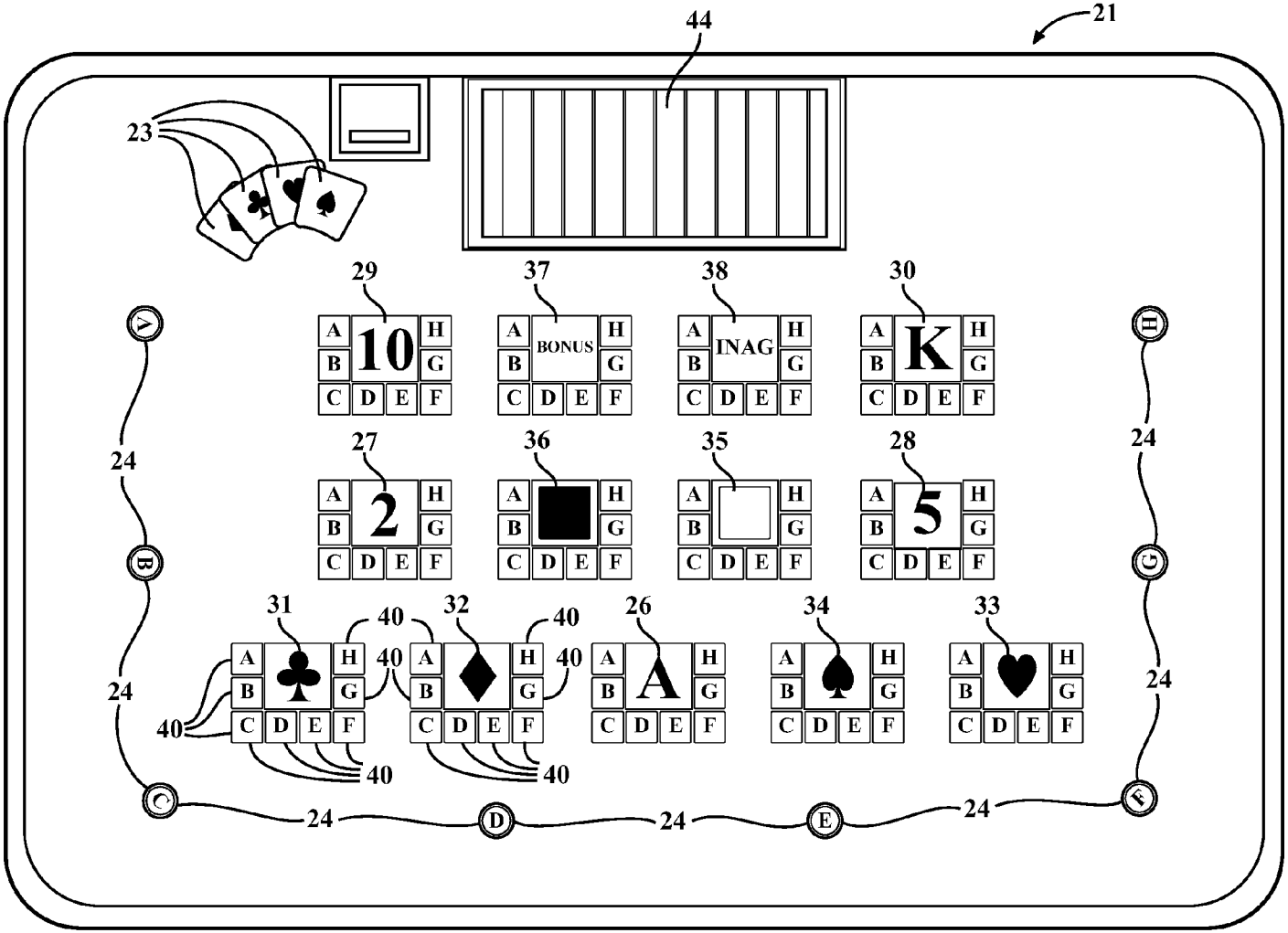
FIG. 2 is a top view of the betting surface of the exemplary embodiment.
Figure 3:
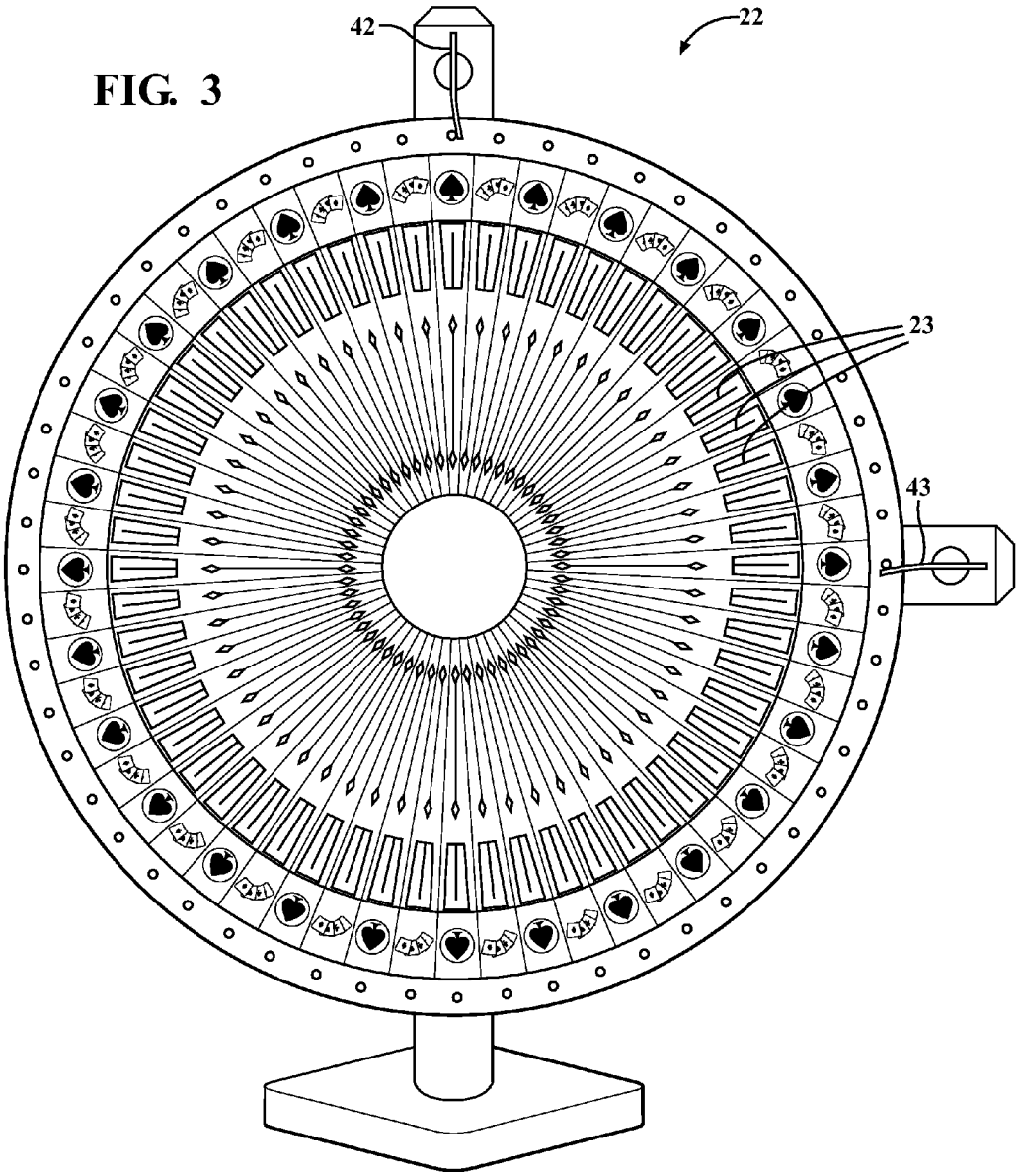
FIG. 3 is a front view of the vertical shuffler of the exemplary embodiment.

The betting surface 21 presents a plurality of sequentially ordered player positions with each player position presenting a unique player indicia 24. As shown in FIG. 2, the indicia 24 of the exemplary embodiment are sequentially ordered with the letters A through F. Alternatively, the indicia 24 could be numbers, colors, or any other distinct symbols. In the exemplary embodiment, up to eight players can be stationed at the playing surface with no more than one player being stationed at each of the player positions. Players can leave their player position at any time between rounds and new players can take the vacated spots. The casino card game 20 can be played with as few as one player or as many players as there are player positions.

The betting surface 21 additionally includes a dealer position distinct from the player positions. The dealer position is located behind the betting surface 21 and adjacent the vertical shuffler 22 in the exemplary embodiment. As shown in FIG. 1, a dealer 25 is positioned at the dealer position for managing the casino card game 20. It should be appreciated that when the game is played electronically, the dealer 25 and the dealer position may not be necessary.

Figure 4:
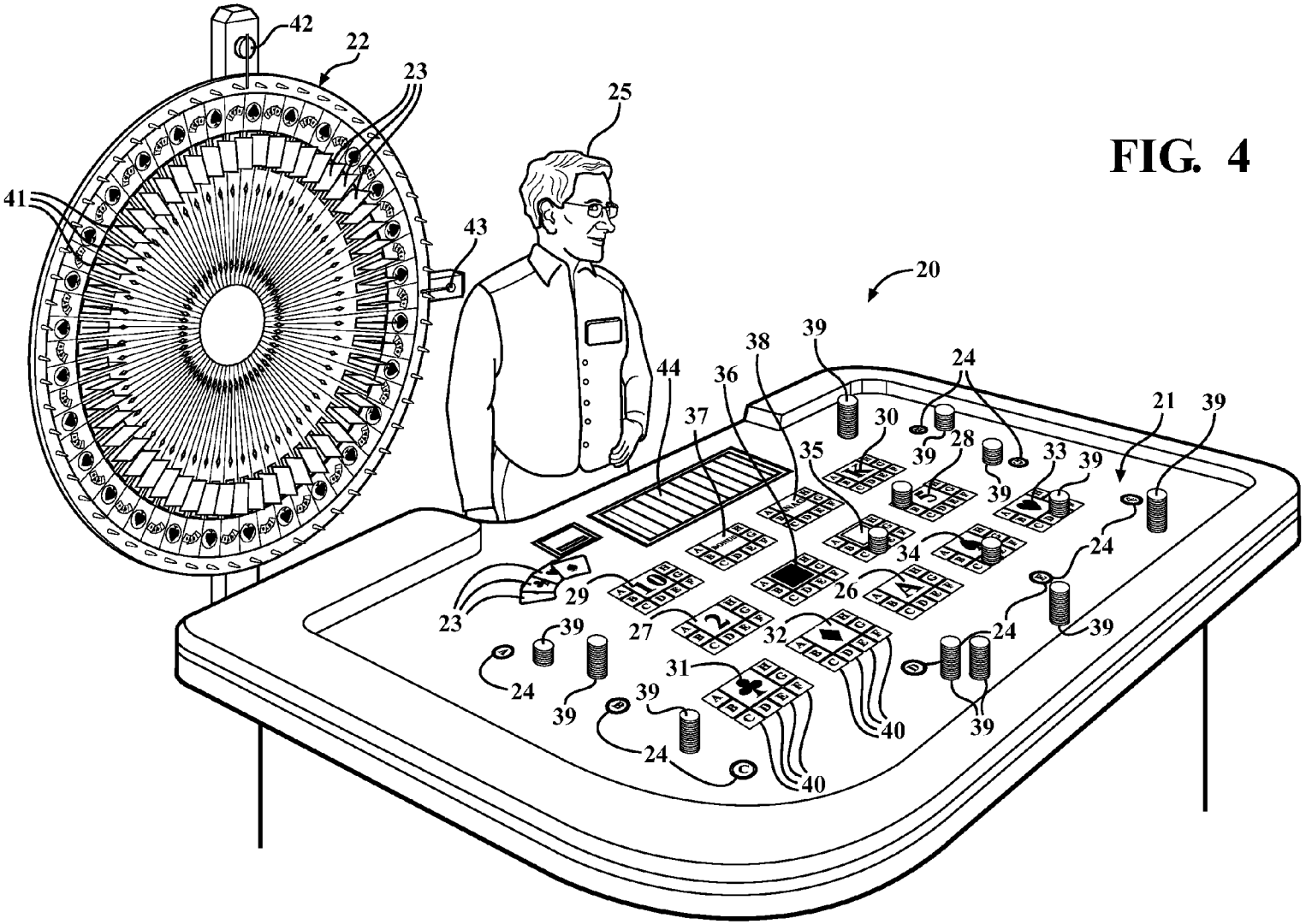
FIG. 4 is a perspective view of the exemplary embodiment of the casino card game during a round of the game.

The betting surface 21 presents a plurality of value wagering areas 26-30 for allowing players to wager on the value of the winning card 23, a plurality of suit wagering areas 31-34 for allowing players to wager on the suit of the winning card 23, and a plurality of color wagering areas 35, 36 for allowing players to wager on the color of the winning card 23. Additionally, the betting surface 21 presents two special wagering areas 37, 38 for allowing players to wager on the special cards 23. As shown in FIG. 4, the players may use tokens 39 to place their wagers on the wagering areas 26-38.

The value wagering areas 26-30 of the betting surface 21 of the exemplary embodiment include an aces wagering area 26, a deuces wagering area 27, a fives wagering area 28, a tens wagering area 29, and a kings wagering area 30. The suit wagering areas 31-34 of the betting surface 21 of the exemplary embodiment include a clubs wagering area 31, a diamonds wagering area 32, a hearts wagering area 33, and a spades wagering area 34. The color wagering areas 35, 36 include a red wagering area 35 and a black wagering area 36. Additionally, the exemplary embodiment includes an BONANZA wagering area 37 and a INAG wagering area 38 for allowing the players to place wagers on the BONANZA and INAG special cards 23 respectively. In other words, there is a wagering area 26-38 for each of the values, suits, and colors of the cards 23 in the card selector 22.

As best shown in FIG. 2, a replica of each of the unique player indicias 40 is affixed within the boundaries of each of the wagering areas 26-38 to provide a place for the respective players to place their wagers. During the game, each of the players may only place tokens 39 on the indicias 40 of the wagering area 26-38 matching the indicia 24 of the player's position. As shown in FIG. 4, tokens 39 are placed on the indicia 24 of various wagering areas 26-38 to represent the players' wagers. The indicias 40 allow the dealer 25 to discern the respective wagers without reliance upon the use of color.

The card selector 22 of the exemplary embodiment is a vertical shuffler 22 rotationally disposed adjacent the betting surface 21. The vertical shuffler 22 of the exemplary embodiment is wheel-shaped and presents a plurality of card slots 41 disposed along its circumference. The cards 23 are disposed randomly in the slots of the vertical shuffler 22 with the faces of the cards 23 facing perpendicularly to the players. If a custom set of cards 23 are used, the faces of the cards 23 cannot be seen by the players. However, if standard playing cards 23 are used, one corner of each card can be seen when the vertical shuffler 22 comes to a stop. If this is an issue with the casino, then the cards 23 may be placed in custom sleeves to block this. None of the indicia on the cards can be seen when the vertical shuffler 22 is spinning as they will appear as a blur to the naked eye.

Two flappers 42, 43 are disposed adjacent to the vertical shuffler 22. A first flapper 42 is positioned on the top of the vertical shuffler 22 and a second flapper 43 is positioned ninety degrees away from the first flapper 42 and adjacent to the dealer 25 position. The first flapper 42 only functions to provide sound and to help slow the vertical shuffler 22 after it is spun. In addition to providing additional sound and slowing the vertical shuffler 22, the second flapper 43 is used to determine the winning card 23.

Each round of the casino card game 20 preferably comprises five steps, and players are free to leave or join the game in between rounds. The first step of each round is to have the players place tokens 39 on their respective indicias 40 affixed to the wagering areas 26-38. The players can place as many tokens 39 as they have on as many wagering areas 26-38 as they desire.

The second step is to determine the winning card 23. In the exemplary embodiment, the dealer 25 spins the vertical shuffler 22 and allows the vertical shuffler 22 to come to a stop. Once it reaches a stop, the card 23 identified by the second flapper 43 is the winning card 23. As discussed above, the players may or may not be able to see the faces of the cards 23 in the vertical shuffler 22. Accordingly, the dealer 25 then removes the winning card 23 from its slot in the vertical shuffler 22 and displays the face of the winning card 23 to the players.

The third step is to identify the winning wagering areas 26-38. Lights may be used to illuminate the winning wagering areas 26-38, a special token 39 or other object can be placed on each winning wagering area 26-38, or any other desired means can be used to identify the winning wagering areas 26-38. If the winning card 23 is one of the special cards 23, i.e. the INAG card 23 or the BONANZA card 23, then only its wagering area 37, 38 is identified. However, if the winning card 23 is one of the playing cards 23, then the value 26-30, suit 31-34, and color 35, 36 wagering areas associated with the winning card 23 are all identified. For example, if the two of clubs is drawn from the vertical shuffler 22, the dealer must identify the deuces wagering area 27, the clubs wagering area 31, and the black wagering area 36.

The fourth step is to remove all of the tokens 39 from the non-identified wagering areas 26-38. In the exemplary embodiment, the dealer 25 removes the tokens 39 to a token tray 44. Because of the player indicias 40 on the wagering areas 26-38, the need for each player to have his or her own distinct color token 39 (as in the roulette game) is eliminated and regular value tokens 39 can be used by all players. This simple way of displaying the player indicias 40 around each wagering area 26-38 increases the number of rounds per hour that the casino card game 20 can be played, thus increasing the bottom line potential for the casino.

The fifth step is paying the winning wagers. The dealer 25 places tokens 39 on the identified wagering areas 26-38 according to a predetermined pay-out table. Below is the pay-out table of the exemplary embodiment:

| Wagering Area | Pay-Out |
|---|---|
| Aces | 1 to 1 |
| Deuces | 2 to 1 |
| Fives | 5 to 1 |
| Tens | 10 to 1 |
| Kings | 20 to 1 |
| INAG | 40 to 1 |
| BONANZA | 40 to 1 |
| Clubs | 3 to 1 |
| Spades | 3 to 1 |
| Diamonds | 3 to 1 |
| Hearts | 3 to 1 |
| Red | 1 to 1 |
| Black | 1 to 1 |

It should be appreciated that the pay-outs can be adjusted by the dealer or they can be directly tied to the cards in the card selector. For example, if the dealer changes the proportion of the cards in the card selector, the pay-out table can be automatically updated to reflect the new odds.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. In addition, the reference numerals in the claims are merely for convenience and are not to be read in any way as limiting.

What is claimed is:

1. A method of playing a casino card game comprising:

providing a betting surface having a plurality of player positions and a plurality of value wagering areas for receipt of a wager on a value of a playing card, a plurality of suit wagering areas for receipt of a wager on a suit of the playing card, and a plurality of color wagering areas for receipt of a wager on a color of the playing card;

disposing a vertical card selector adjacent the betting surface, the card selector configured for rotation in a generally vertical plane and defining an axis of rotation that is generally parallel to the betting surface, the card selector having a plurality of slots adjacent a perimeter thereof that are each sized and configured to receive a playing card therein;

providing a plurality of physical playing cards with each card having a value, a suit and a color displayed on a face thereof, which correspond to the plurality of value wagering areas;

removeably placing one of the plurality of physical playing cards in each of the plurality of slots such that the face of the playing card is oriented generally perpendicular to the axis of rotation and so that at least a portion of face of the playing card is concealed when it resides in the slot;

receiving wagers on one or more of the value wagering areas, the suit wagering areas, and the color wagering areas;

rotating the vertical card selector about the axis of rotation and allowing it to come to rest with a flapper associated with the vertical card selector identifying a winning card;

identifying the value wagering area associated with the value of the winning card and identifying the suit wagering area associated with the suit of the winning card and identifying the color wagering area associated with the color of the winning card; and resolving each of the wagers on the identified wagering areas according to a predetermined payout.

2. The method as set forth in claim 1 wherein the vertical card selector further includes at least one special card having a special value.

3. The method as set forth in claim 2 further including a first special card and a second special card disposed in the vertical shuffler.

4. The method as set forth in claim 3 wherein a plurality of the playing cards have an ace value and a plurality of the playing cards have a deuce value and a plurality of the playing cards have a five value and a plurality of the playing cards have a ten value and a plurality of the playing cards have a king value.

5. The method as set forth in claim 4 wherein the value wagering areas on the betting surface include an aces wagering area and a deuces wagering area and a fives wagering area and a tens wagering area and a kings wagering area and an first special card wagering area and a second special card wagering area.

6. The method as set forth in claim 3 wherein a plurality of the playing cards have a clubs suit and a plurality of the playing cards have a spades suit and a plurality of the playing cards have a diamonds suit and a plurality of the playing cards have a hearts suit.

7. The method as set forth in claim 6 wherein the suit wagering areas include a clubs wagering area and a spades wagering area and a diamonds wagering area and a hearts wagering area.

8. The method as set forth in claim 3 wherein a plurality of the playing cards have a red color and a plurality of the playing cards have a black color.

9. The method as set forth in claim 8 wherein the color wagering areas include a red wagering area and a black wagering area.

10. The method as set forth in claim 1 wherein the step of providing the betting surface further includes presenting a unique player indicia at each of the player positions and further including the step of providing a replica of each of the unique player indicias on each of the wagering areas on the betting surface.

11. A method of playing a casino card game comprising:

providing a betting surface having a plurality of sequentially ordered player positions with each player position presenting a unique player indicia for use by a player at each of the player positions;

providing a dealer position distinct from the player positions;

disposing a vertical card shuffling device for determining a winning card adjacent the dealer position, wherein the vertical card shuffling device has a face portion that is oriented generally perpendicular to the betting surface and which defines a generally horizontal axis of rotation, wherein the vertical card shuffling device includes a plurality of slots formed in the face portion for removable receipt of a plurality of physical playing cards;

removeably providing a first special card with a first value and without a suit in one of the slots of the vertical card shuffling device and providing a second special card with a second value and without a suit in another of the slots of the vertical card shuffling device;

removeably providing in the remaining slots of the vertical card shuffling device twenty-four playing cards having an ace value and fifteen playing cards having a deuce value and seven playing cards having a five value and four playing cards having a ten value and two playing cards having a kings value and wherein thirteen of the playing cards have a suit of clubs and thirteen of the playing cards have a suit of diamonds and thirteen of the playing cards have a suit of hearts and thirteen of the playing cards have a suit of spades and wherein twenty-six of the playing cards have a color of red and twenty-six of the playing cards have a color of black;

providing a first flapper structure adjacent to the vertical card shuffling device for slowing the vertical card shuffling device after it is spun by the dealer and providing a second flapper for determining the winning card after the vertical card shuffling device has been spun by the dealer;

providing a first special card wagering area on the betting surface for wagering on the first special card;

providing a second special card wagering area on the betting surface for wagering on the second special card;

providing an aces wagering area on the betting surface for wagering on the playing cards having a value of ace;

providing a deuces wagering area on the betting surface for wagering on the playing cards having a value of deuce;

providing a fives wagering area on the betting surface for wagering on the playing cards having a value of ten;

providing a tens wagering area on the betting surface for wagering on the playing cards having a value of ten;

providing a kings wagering area on the betting surface for wagering on the playing cards having a value of king;

providing a clubs wagering area on the betting surface for wagering on the playing cards having a suit of clubs;

providing a diamonds wagering area on the betting surface for wagering on the playing cards having a suit of diamonds;

providing a hearts wagering area on the betting surface for wagering on the playing cards having a suit of hearts;

providing a spades wagering area on the betting surface for wagering on the playing cards having a suit of spades;

providing a red wagering area on the betting surface for wagering on the playing cards having a color of red;

providing a black wagering area on the betting surface for wagering on the playing cards having a color of black;

providing a replica of each of the unique player indicias on each of the wagering areas on the betting surface;

receiving wagers on one or more of the wagering areas;

spinning the vertical card shuffling device and allowing the vertical card shuffling device to come to a stop with one of the first and second flappers pointing at the winning card;

removing the winning card from the slot of the vertical card shuffling device and displaying the winning card to the players, identifying the wagering area associated with the value of the winning card;

identifying the wagering area associated with the suit of the winning card in response to the winning card being a playing card;

identifying the wagering area associated with the color of the winning card in response to the winning card being a playing card;

paying the wagers on each of the identified wagering areas according to a predetermined payout table; and removing the remainder of the wagers from the unidentified wagering areas on the playing surface.

12. A method of playing a casino card game comprising:

providing a betting surface having a plurality of player positions and at least one player positioned at one of the player positions, providing a card selector adjacent the betting surface, wherein the card selector is a vertical shuffler disposed for rotation in a generally vertical plane about a horizontal axis, the card selector including a plurality of card locations on a face thereof for each releaseably receiving a playing card, the card selector including a resilient flapper;

removeably placing a plurality of playing cards in the plurality of card locations with each card having a value and a suit and a color displayed on a face thereof, wherein the face of each of the cards is concealed when located in a respective one of the card locations;

providing a plurality of value wagering areas with each of the values of the playing cards in the card selector having a corresponding value wagering area, and wherein each of the value wagering areas has a different payout associated therewith;

providing a plurality of suit wagering areas with each of the suits of the playing cards in the card selector having a corresponding suit wagering area;

providing a plurality of color wagering areas with each of the colors of the playing cards in the card selector having a corresponding color wagering area;

placing wagers on the wagering areas;

spinning the card selector and allowing it to come to a rest with the flapper pointing at a winning card;

identifying the value wagering area associated with the value of the winning card and identifying the suit wagering area associated with the suit of the winning card and identifying the color wagering area associated with the color of the winning card;

paying each of the wagers on the identified wagering areas according to a predetermined payout; and wherein the plurality of playing cards are releaseably retained to the vertical shuffler during such that they will not become disassociated from the vertical shuffler during rotation thereof and may be readily removed from the vertical shuffler when at rest.

13. The method of claim 12, wherein the vertical card shuffler includes a perimeter with a plurality of slots disposed adjacent the perimeter.

14. The method of claim 13, a respective one of the plurality of playing cards is removeably disposed in each of the slots of the vertical card shuffler, each of the playing cards being continuously supported in its respective slot so that the face of the playing card is oriented generally perpendicular to an axis of rotation of the wheel.

15. The method as set forth in claim 12 wherein the vertical card shuffler further includes at least one special card having a special value.

16. The method as set forth in claim 15 further including a first special card and a second special card disposed in the vertical card shuffler.

17. The method as set forth in claim 16 wherein a plurality of the playing cards have an ace value and a plurality of the playing cards have a deuce value and a plurality of the playing cards have a five value and a plurality of the playing cards have a ten value and a plurality of the playing cards have a king value.

18. The method as set forth in claim 17 wherein the value wagering areas on the betting surface include an aces wagering area and a deuces wagering area and a fives wagering area and a tens wagering area and a kings wagering area and an first special card wagering area and a second special card wagering area.

* * * * *